United States Patent [19]

Wootton

[11] Patent Number: 4,760,311

[45] Date of Patent: Jul. 26, 1988

[54] SUB-NANOSECOND RISE TIME MULTI-MEGAVOLT PULSE GENERATOR

[75] Inventor: Roy E. Wootton, Murrysville Boro., Pa.

[73] Assignee: Westinghouse Electric Corp., Pittsburgh, Pa.

[21] Appl. No.: 885,632

[22] Filed: Jun. 15, 1986

[51] Int. Cl.[4] ..... H01J 25/00

[52] U.S. Cl. ..... 315/4; 315/3; 315/5; 328/64; 328/65

[58] Field of Search ..... 328/57, 58, 64, 65, 328/229; 315/3, 4, 5

[56] References Cited

U.S. PATENT DOCUMENTS

| | | | |
|---|---|---|---|
| 2,462,860 | 3/1949 | Grieg | 328/58 |
| 2,982,917 | 5/1961 | Aaland et al. | 328/229 |
| 3,309,557 | 3/1967 | Crowley-Milling | 315/4 X |
| 3,360,678 | 12/1967 | Kerns | 328/64 X |
| 3,374,387 | 3/1968 | Schmid | 315/3 |
| 3,495,125 | 2/1970 | Koontz | 328/299 |
| 4,185,244 | 1/1980 | Weiner | 328/65 |
| 4,629,937 | 12/1986 | Srivastava et al. | 328/229 |
| 4,656,430 | 4/1987 | Olson | 315/4 |

OTHER PUBLICATIONS

Ian D. Smith et al., "Pulsed Power for EMP Simulators", IEEE Transactions on Antennas Propagation, vol. AP-26, No. 1, Jan. 1978.

*Primary Examiner*—Saxfield Chatmon
*Attorney, Agent, or Firm*—R. P. Lenart

[57] ABSTRACT

A sub-nanosecond rise time megavolt pulse generator is disclosed. The generator utilizes an induction energy store together with electron beams for generating a sub-nanosecond high voltage pulse wave-front. The electron beams are deflected to establish the wave-front. In a preferred form multiple electron beams together with a waveguide of particular shape provide simultaneous converging wave-fronts that are directed to a local area.

13 Claims, 4 Drawing Sheets

SUB-NANOSECOND RISE TIME MULTI-MEGAVOLT PULSE GENERATOR

STATEMENT OF GOVERNMENT INTEREST

The U.S. Government has a paid-up license in this invention pursuant to a contract between the Westinghouse Electric Corporation and the Department of the Army.

BACKGROUND OF THE INVENTION

The present invention relates to pulse generation and, in particular, to a sub-nanosecond multi-megavolt pulse generator. Pulse power development in the United States has been basically motivated by the desire to create simulation of nuclear weapons effects. A paper entitled "Pulsed Power For EMP Simulators" by Ian D. Smith and Harlan Aslin, *IEEE Transactions on Antennas and Propagation,* Vol. AP-26, No. 1, January 1978, provides a good overview of the development of pulse power simulators. Difficulty with the prior art pulse generators is often encountered in an attempt to develop magavolt or greater pulses with rise times of less than a nanosecond. Existing methods for generating multi-megavolt pulses with rise-times less than 10 ns use spark gaps. Typically, a multimegavolt Marx generator is used to develop a current which is built up comparatively slowly in a "peaking" capacitor in a time long compared with the desired voltage rise time. FIG. 1 shows a typical prior art scheme. The current in the "peaking" capacitor C2 is suddenly diverted to flow into load Z. This sudden diversion can be achieved in 1–10 ns. The limitations on the suddenness with which this build-up of current in load Z can be performed includes stray inductance and capacitance in the spark gap and spark channel and the rate at which the spark channel becomes conductive. The pulse generator of the present invention overcomes these difficulties experienced with prior art generators.

SUMMARY OF THE INVENTION

The common feature of the usual prior art pulse technology is that pulse energy is first stored on a capacitor at high voltage, and that with a matched load, only one-half of this voltage appears across the load. The pulse generator of the present invention initially stores the energy inductively at a comparatively low voltage; the highest voltage developed appears across the load. For a given voltage across a matched load, the generator of the present invention has to withstand only half the normal voltage. This eases the insulation requirements particularly in the case of some malfunctions of the circuit and reduces corona losses. The voltage also exists (typically) for a shorter time.

The present invention provides a multi-megavolt sub-nanosecond pulse generator. The generator comprises inductive energy storage means for storing inductive energy prior to initiation of a sub-nanosecond rise-time high voltage pulse wave-front. The generator also comprises electron beam means for generating a predetermined number of high energy electron beams along predetermined lines of trajectory for initially establishing an inductive energy store in the area of the inductive energy storage means. Electron beam deflector means are provided for deflecting the electron beams to cause the stored inductive energy to very rapidly convert to electrostatic energy, thereby producing sub-nanosecond rise-time high voltage pulse wave-fronts. A pulse wave front convergence chamber is provided for receiving the high voltage pulse wave fronts produced upon deflection of the electron beams, whereby an area of convergence of the high voltage pulse wave-fronts is established momentarily within the convergence chamber.

Preferably, the inductive energy storage means of the present invention comprises a hollow cylindrical member, a pair of oppositely disposed frustoconical end members affixed to the ends of the hollow cylindrical member. Each of the frustoconical end members includes a conical portion having a substantially flat disk-shaped end portion affixed thereto. The frustoconical end members are aligned with each other. The hollow cylindrical member has a height such that if lines were projected from said conical portions of the frustoconical members, they would preferably intersect at the apexes of the conical portions. The disk-shaped end portions are preferably maintained in substantial parallel alignment with one another.

Preferably, the pulse convergence chamber is formed by the space between the parallel flat disk-shaped end members.

The electron beam means of the present invention preferably comprises power supply means of a predetermined power, and an electron gun means connected in a circuit with the power supply means. Preferably, the electron beam means further comprises high vacuum beam containment means for carrying the electron beams between the frustoconical end members. A first one of the frustoconical end members desirably has first aperture means therethrough for permitting entry of the electron beams into the inductive energy storage means; a second one of the frustoconical end members desirably has second aperture means therethrough for permitting exit of the electron beams from the inductive energy storage means.

The pulse generator of the present invention also preferably comprises beam dump and X-ray trap means for receiving the electron beams and for substantially preventing re-entry of reflected electrons and X-rays into the inductive energy storage means through the second aperture means. The beam dump and X-ray trap means preferably comprises a plurality of hollow tubular members extending at an angle from the line of trajectory of the electron beams to prevent reflection of the electrons and X-rays back through the second aperture means.

Preferably, the beam deflection means comprises electrostatic deflection plate means, including a pair of deflection plates positioned at opposite sides of each of the electron beams. Deflection plate power supply mean is provided in a circuit with the deflection plate means. The deflection plate power supply means is for supplying power to the deflection plates. Alternatively, the beam deflection means may comprise a magnetic deflection means, or a combination of magnetic deflection means and electrostatic deflection plates may be used.

Preferably, the deflection plate power supply means of the present invention comprises a power supply switching means for simultaneously deflecting the electron beams, and cable means for connecting in circuit the switching means and the deflection plates. The cable means comprises a plurality of cables of equal transmission times, whereby upon the switching means being activated the electron beams are deflected simultaneously.

Preferably, the first aperture means and the second aperture means are positioned opposite one another proximate the edges of the disk-shaped end portions of the frustoconical end members.

The switching means desirably comprises a spark gap means for producing a spark to simultaneously power the deflection plates.

BRIEF DESCRIPTION OF THE DRAWINGS

For a better understanding of the invention, reference may be had to the accompanying drawings, in which.

BRIEF DESCRIPTION OF THE PREFERRED EMBODIMENTS

Figure 1:
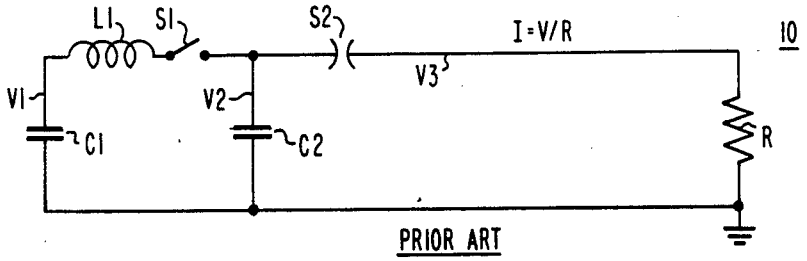
PRIOR ART FIG. 1
FIG. 1 is a schematic diagram of a typical prior art pulse generator arrangement.
Figure 2:
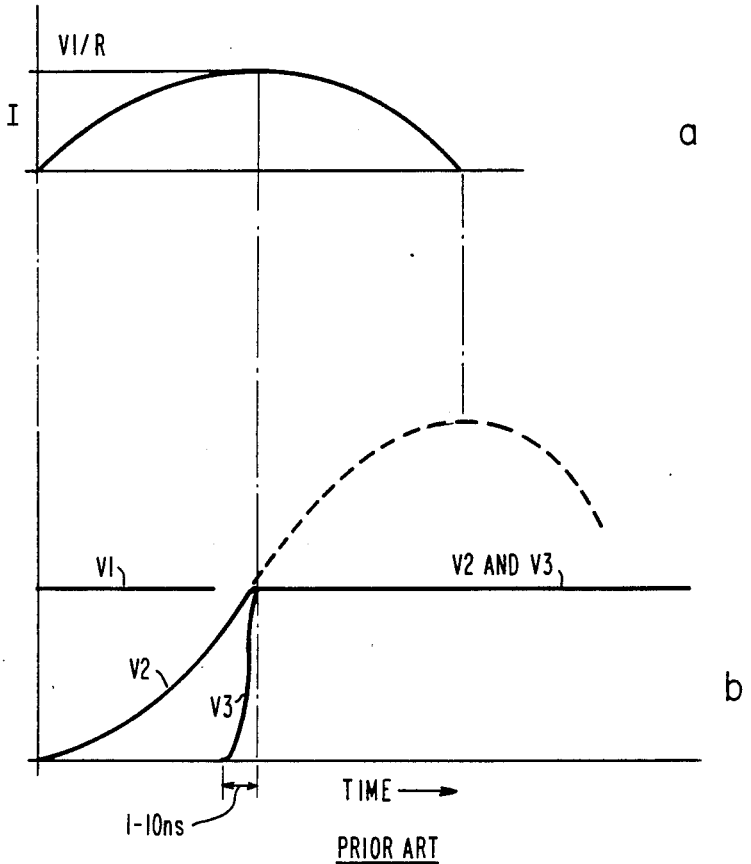
PRIOR ART FIG. 2
FIG. 2 includes a graph "a" showing the current waveform produced by the circuit of FIG. 1 versus time and graph "b" showing the voltage waveform produced by the circuit of FIG. 1 versus time.

Referring to FIG. 1, there is shown a schematic diagram of a prior art pulse generator for generating multi-megavolt pulses with rise-times between 1–10 ns. C1, L1 and S1 represent a typical Marx generator known in the art. C1 is much greater than C2. The object of this circuit is to create a current I flowing through C2 which is equal to V/R of the transmission line T of impedance Z=R. As shown in FIG. 2, the current in the inductor shown in graph a is initially zero and the voltage on C1 is V1. When switch S1 is closed, C2 begins to charge up as indicated in graph b. Since C2 is much smaller than C1, if it were not for S2, V2 would charge to almost twice V1. The prior art circuit is designed so that S2 closes when V2 is equal to V1. Also at that time, as shown in FIG. 2, the current through L1 is equal to V1/R. This prevents oscillation of the transmission line upon closing of switch S2. The switch S2 is typically a spark gap. S2 and C2 have inherent inductances and capacitances which prevent a rise time of less than one nanosecond. V3 depicts the rise time as shown in graph b of FIG. 2, which may be between 1–10 nanoseconds or greater.

It is the purpose of the present invention to provide a pulse generator with a rise time of less than a nanosecond.

Figure 3:
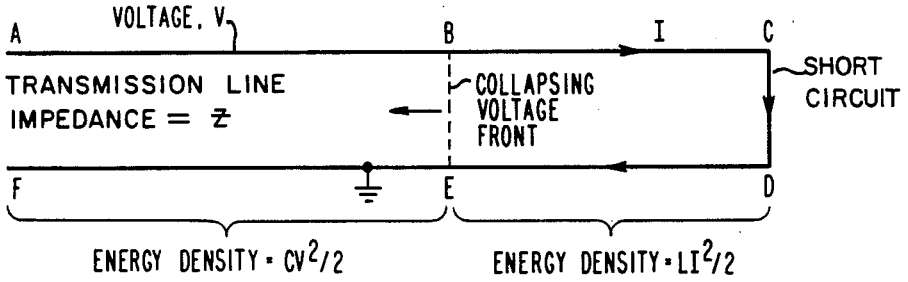
FIG. 3 is a schematic diagram of a charged transmission line showing the effects of a short circuit across the line.

With reference to FIG. 3, by way of further explanation, a transmission line of impedance Z charged at a voltage V will initially supply a current $I=V/Z$ through a short circuit placed across one end from C to D. A wave of collapsing voltage, BE, shown by the dashed lines, subsequently propagates along the line towards AF at a speed $v=1/(\sqrt{LC})$. If BE in FIG. 3 represents the collapsing voltage wave-front traveling toward AF, then the stored energy in the line between AF and BE is entirely electrostatic, and the energy per unit length of the line is equal to $CV^2/2$, where C is the capacitance per unit length of the line. In contrast, all the stored energy behind BE between BE and CD is stored magnetically with an energy density of $LI^2/2$, where L is the inductance per unit length of the line. It important to note that if the line is loss-less (e.g., made of super-conducting conductors and loss-less dielectrics), no energy loss or even movement of energy is involved. The energy storage density is the same after the wave is passed as before, so that $LI^2/2$ is equal to $CV^2/2$ and, therefore, V/I is equal to $\sqrt{L/C}$. This is consistent with the impedance of the line $Z=\sqrt{LC}$. Thus, the passage of the wave front BE past any point on the line represents the conversion of the stored energy at that point from electrostatic to a magnetic form.

Figure 4:
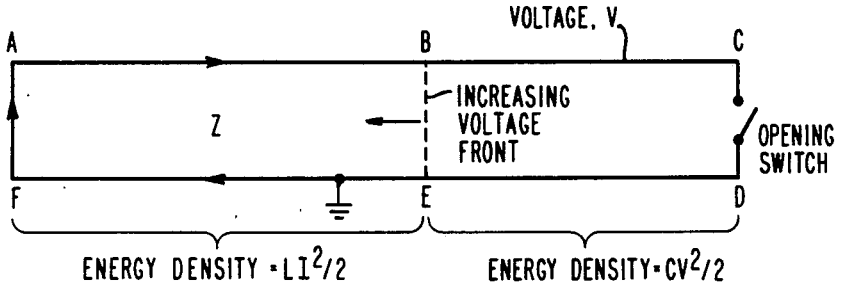
FIG. 4 is a schematic diagram of a transmission line normally having a closed loop and carrying a current, and the effects of opening a switch in the circuit.
Figure 5A:
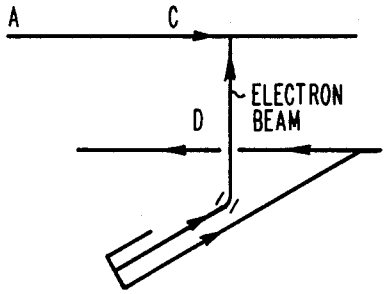
FIG. 5A is a schematic diagram of a portion of the circuit shown in FIG. 4 where the opening switch has been replaced by an electron beam and associated deflection plates.
Figure 5B:
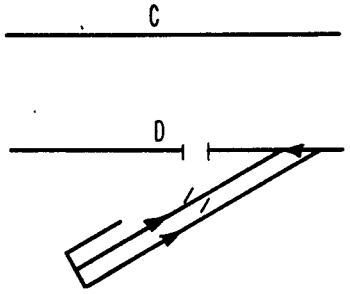
FIG. 5B is a schematic diagram of a portion of the circuit shown in FIG. 5A, with the electron beam undeflected.

In contrast to the circuit shown in FIG. 3 is the circuit shown in FIG. 4. In the circuit shown in FIG. 4, a steady current I initially flows in the loss-less circuit A C D F; all points in the circuit are at the same potential, and the stored magnetic energy is $LI^2/2$ per unit length of line, but no electrostatic energy. When the current in the path CD is interrupted, a voltage $V=IZ$ will be generated and an energy conversion front, BE, will propagate toward AF as before, but this time the conversion will be from magnetic to electrostatic energy. This circuit is utilized in the present invention.

Figure 6:
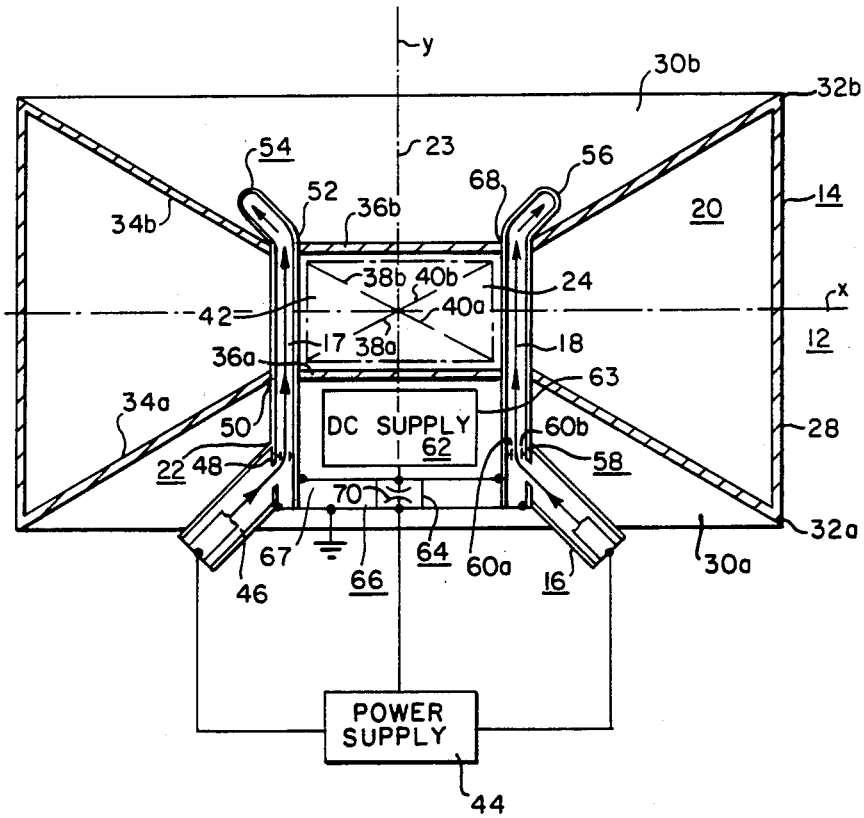
FIG. 6 is a schematic diagram of the pulse generator of the present invention.
Figure 7:
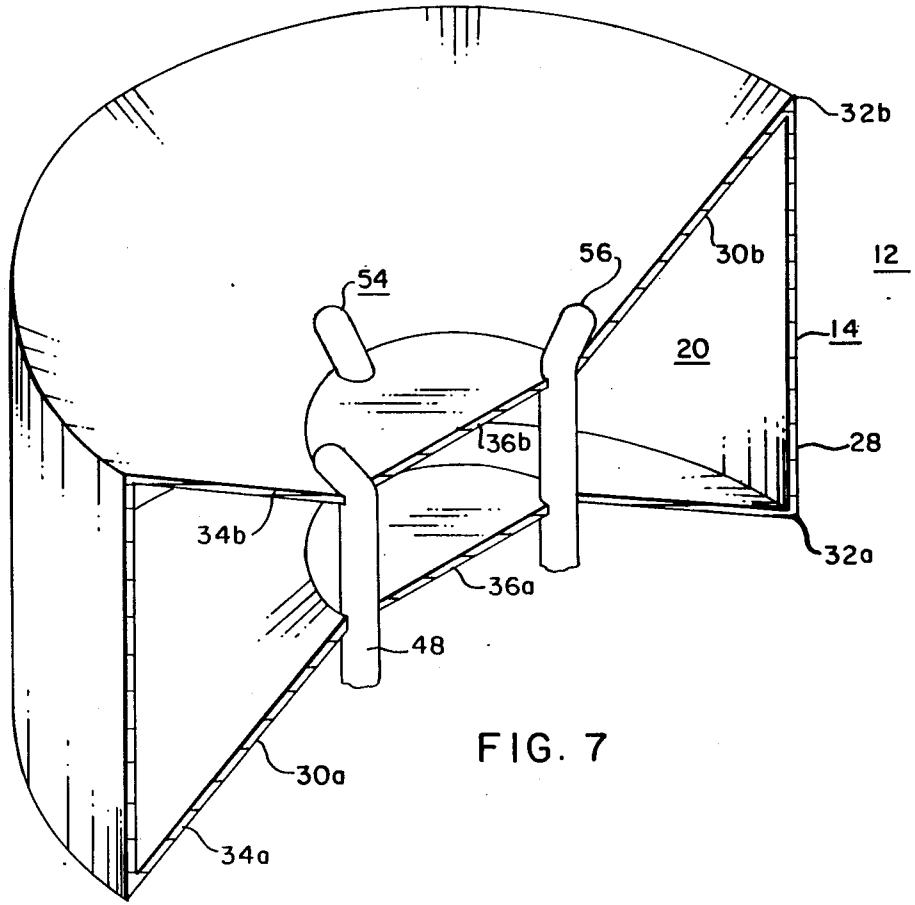
FIG. 7 is an isometric view partially broken away, of a portion of the pulse generator of the present invention shown in FIG. 6, particularly showing the inductive energy storage means, together with the electron beam means and electron beam dump and X-ray trap means.

With reference to FIGS. 4, 5A, 5B, 6, 7, there is provided a multi-megavolt sub-nanosecond rise-time pulse generator 12. The generator 12 comprises inductive energy storage means 14 for storing inductive energy prior to initiation of a sub-nanosecond rise-time high voltage pulse wave front such as discussed previously with reference to FIG. 4. Electron beam means 16 generate a predetermined number of high energy electron beams 17 along predetermined lines of trajectory 18 for initially establishing an inductive energy store 20 in the area of the inductive energy storage means 14. The inductive energy storage means 14 may be made of aluminum or copper, for example. Electron beam deflector means is provided for deflecting the electron beams 18 to cause the stored inductive energy 20 to very rapidly convert to electrostatic energy, thereby producing sub-nanosecond rise-time high voltage pulsed wave fronts. A pulsed wave front convergence chamber 24 is provided for receiving the high voltage pulsed wave fronts produced upon deflection of the electron beams, as shown in FIGS. 6 and 7, whereby a region of convergence on axis 23 of the high voltage pulsed wave front is established momentarily within the convergence chamber 24.

One preferred form of the invention which provides constant impedance in the induction energy store to provide a constant voltage wave-front is shown in FIGS. 6 and 7. The inductive energy storage means 14 comprises a hollow cylindrical member 28. A pair of oppositely disposed frustoconical end members 30*a*, 30*b* are affixed to the edges 32*a*, 32*b* of the hollow cylindrical member 28. Each of the frustoconical end members 30*a*, 30*b* include a conical portion 34*a*, 34*b* having a substantially flat disk-shaped end portion 36*a*, 36*b*. The frustoconical end members 30*a*, 30*b* are aligned with each other, as shown in FIGS. 6, 7. The hollow cylindrical member has a height such that if lines 38*a*, 38*b* such as shown in FIG. 6 were projected from the conical portions 34*a*, 34*b*, respectively, they would intersect at the apexes 40*a*, 40*b* of the conical portions 34*a*, 34*b*. Preferably, the disk-shaped end portions 36*a*, 36*b* are maintained in substantial parallel alignment with one another.

Preferably, the pulse convergence chamber 24 is formed by the space 42 between the parallel flat disk-shaped end members 36*a*, 36*b*.

As a further aspect of the present invention, the electron beam means 16 comprises power supply means 44, which may be a conventional DC power supply such as known in the art, and may produce 100 kV, 100 kA. Electron gun means 46 are connected in a circuit with a power supply means 44. The electron gun means 46 is disposed in predetermined alignment as shown in FIG. 6. The electron gun 46 is conventional. Preferably, the electron beam means further comprises high vacuum beam containment means 48 for carrying the electron beams 17 between the frustoconical end members 30*a*, 30*b*. The high vacuum beam containment means 48 may be made of glass or plexiglas, for example.

Preferably, a first of the frustoconical end members 30*a* has first aperture means 50 therethrough for permitting entry of the electron beam 17 into the inductive energy storage means 14. Also, a second of the frustoconical end members 30*b* has second aperture means 52 therethrough for permitting exit of the electron beam 17 from the inductive energy storage means 14.

Another aspect of the present invention provides, as shown in FIG. 6, a beam dump and X-ray trap means 54 comprising a plurality of hollow tubular members 56 extending at an angle such as 45° from the line of trajectory 18 of the electron beam 17 to prevent reflection of the trons and X-rays back through the second aperture means 52.

The beam deflection means 22 comprises electrostatic deflection plate means 58 including a pair of deflection plates 60*a*, 60*b* positioned at opposite sides of each of the electron beams 17. Alternatively, magnetic deflection means may be used. Deflection plate power supply means 62 is provided in a circuit with the deflection plate means 58. The deflection plate power supply means 62 is for supplying power to the deflection plates 60*a*, 60*b*. Preferably, the deflection plate power supply means 62 comprises power supply 63 which may be a standard DC power supply. Power supply 62 also comprises switching means 64 for simultaneously deflecting the electron beams 17. Cable means 66 in circuit with power supply 62 and switching means 64 which comprise a plurality of cables 67 of equal transmission time, whereby upon the switching means being activated the electron beams 17 are deflected simultaneously before entering the first aperture means 50. Preferably, the first aperture means 50 and the second aperture means 52 are positioned opposite one another proximate the edges 68 of the disk-shaped end portions 36*a*, 36*b* of the frustoconical end members 30*a*, 30*b*.

As another aspect of the present invention, the switching means desirably comprises a spark gap means 70 for producing a spark to simultaneously power one deflection plate pair 60*a*, 60*b* for each electron beam.

The present invention utilizing electron beams together with a transmission line to provide an inductive energy store, overcomes the inherent limitations of spark gaps. The advantage of the electron beam is that it can be deflected, i.e., shut off, in much shorter times than the combined inductive and resistive phase times of spark gaps. The electron guns 46 of the present invention can be operated at low voltage; e.g., between 1% and 10% of the output pulse voltage of the machine. The pulse line of the present invention has to withstand only one-half of the voltage of a conventional system using a peaking capacitor such as in the Marx generator circuit described in the prior art FIGS. 1 and 2 (for the same output voltage into a matched load). In general, the voltage wave-front produced by this system exists for a shorter time than in the corresponding conventional system. The pulse generator of the present invention can be designed if necessary to avoid the use of input voltages higher than perhaps 1% of the desired output voltage, since all that is required is that a current I, be established where the output voltage $V=IZ$. This current, I, is effectively a DC current, and the voltage needed to establish it depends only on the DC resistance of the circuit and not on the surge impedance Z. This is in marked contrast to the conventional system where Marx generator of n stages is used, the charging voltage for which has to be at least $(2\times(\text{output pulse voltage of the machine into a matched load}))/n$. Thus if n is less than or equal to 40, the charging voltage has to be 5% or more of the output voltage. The number of stages in a Marx generator is normally kept as low as possible because of unreliability, complexity, cost, time, jitter, weight and size, inherent with a Marx generator, while avoiding problems associated with excessive charging voltages.

The inductive energy storage means 14 as described in the preferred embodiment utilizing a hollow cylindrical cylinder 28 having frustoconical end portions where the height of the cylinder is directly related to the requirement that lines projected from the conical portions 34*a*, 34*b* intersect at the apexes 40*a*, 40*b* to provide constant impedance along the inductive energy store which is symmetrical about plane x indicated in FIG. 6. By maintaining the impedance constant throughout, the inductive energy storage means tends to maintain the pulse voltage constant. It may be desirable to modify this design for special purposes, e.g. non-linear loads.

Upon the beam missing the first aperture 50 a voltage $IZ/2$ will be suddenly generated across CD as shown in FIG. 6. The longest time for this voltage rise to occur is the drift time of the beam electrons across the distance CD. The actual time will be shorter since the effect of the initial part of the voltage rise will be to accelerate the remaining electrons and hence to shorten the drift time for most of the beam electrons once cut-off has started. The electron gun current remains constant during the cut-off process. Thus, there are no inductively induced voltages in the gun circuit while there is an enhanced inductively generated voltage in the inductive energy storage means 14 circuit, which is a transmission line circuit, with inductive energy storage means 14 shown in FIGS. 6, 7 being rotationally symmetrical about the axis y and planar symmetric about plane x and providing a centrally located region of convergence 23 in convergence chamber 24 which is also well screened from the outside world.

The rate at which the voltage, V across CD, rises toward the final value of $I\times Z/2$ will depend upon the details of the deflection process and the subsequent acceleration and drift times of the electrons in space from D to C. For instance, if the electrons were to travel with constant speed across from D to C at one half the speed of light without any acceleration, the drift time would be 1 ns for distance CD of 15 cm. In practice, the time will be shorter for the following reason: As soon as the supply of electrons is cut off by deflecting the beam past the first aperture 50, the current from D to C will begin to fall but not immediately, to zero because there are still electrons in flight, and these represent a current. The inductive current will produce an EMF in a direction which will attempt to maintain the current at its existing value, i.e., to make C positive with respect to D, and thus accelerate the electrons in a direction in which they are already traveling. This will shorten the drift time and bring about a further reduction in current (due to electrons being lost to the electrodes), further increasing EMF in the circuit, a further acceleration of electrons, and so on. This positive feedback will shorten the current-interruption time in the above example below 1 ns.

The use of multiple electron beams which may be deflected simultaneously with the switch means 64, to provides the necessary temporal precision by being driven by a single spark gap with associated cables of matched length is taught by the present invention. This technique allows the generation of converging voltage wave fronts which will achieve high field strengths as well as high voltages with minimal losses, in contrast to many conventional schemes which involve diverging wave fronts, i.e., fields which weaken as they propagate and produce large energy losses through edge effects and undesirably large amounts of energy radiated to the outside world. In the pulse generator 12 shown in FIG. 6, the centrally located area of convergence is located in the area of highest field strength which occurs near the axis of the inductive energy store 14.

I claim:

1. A multi-megavolt sub-nanosecond rise-time pulse generator, said generator comprising:

(a) inductive energy storage means for storing inductive energy prior to initiation of a sub-nanosecond rise-time high voltage pulse wave-front;

(b) electron beam means for generating a predetermined number of high energy electron beams along predetermined lines of trajectory for initially shorting said inductive energy storage means and storing inductive energy in said inductive energy storage means;

(c) electron beam deflector means for deflecting said electron beams thereby opening said inductive energy storage means and causing said stored inductive energy to convert to electrostatic energy, thereby producing sub-nanosecond rise-time very high voltage pulse wave-fronts;

(d) a pulse wave-front convergence chamber for receiving said high voltage pulse wavefronts produced upon deflection of said electron beams, whereby an area of convergence of said high voltage pulse wave-fronts is established momentarily within said convergence chamber.

2. The pulse generator of claim 1, wherein said inductive energy storage means comprises a hollow cylindrical member, a pair of oppositely disposed frustoconical end members affixed to the edges of said hollow cylindrical member, each of said frustoconical end members including a conical portion having a substantially flat disk-shaped end portion affixed thereto, said frustoconical end members aligned with each other, said hollow cylindrical member having a height such that if lines were projected from said conical portions of said frustoconical members, they would intersect at the apexes of said conical portions, said disk-shaped end portions are maintained in substantial parallel alignment with one another.

3. The pulse generator of claim 2, wherein said pulse convergence chamber is formed by the space between said parallel flat disk-shaped end members.

4. The pulse generator of claim 1, wherein said electron beam means comprises power supply means of predetermined power, and electron gun means connected in a circuit with said power supply means.

5. The pulse generator of claim 2, wherein said electron beam means further comprises high vacuum beam containment means for carrying said electron beams between said frustoconical end members.

6. The pulse generator of claim 5, wherein a first of said frustoconical end members has first aperture means therethrough for permitting entry of said electron beams into said inductive energy storage means.

7. The pulse generator of claim 6, wherein a second of said frustoconical end members has second aperture means therethrough for permitting exit of said electron beams from said inductive energy storage means.

8. The pulse generator of claim 7, further comprising beam dump and X-ray trap means for receiving said electron beams and for substantially preventing reentry of reflected electrons and X-rays into said inductive energy storage means through said second aperture means.

9. The pulse generator of claim 8, wherein said beam dump and X-ray trap means comprises a plurality of hollow tubular members extending at an angle from said line of trajectory of said electron beams to prevent reflection of said electrons and X-rays back through said second aperture means.

10. The pulse generator of claim 1, wherein said beam deflection means comprises electrostatic deflection plate means including a pair of deflection plates positioned at opposite sides of each of said electron beams, and deflection plate power supply means in a circuit with said deflection plate means, said reflection plate power supply means for supplying power to said deflection plates.

11. The pulse generator of claim 10, wherein said deflection plate power supply means comprises a power supply, switching means for simultaneously deflecting said beams, cable means connecting said switching means to said power supply, said cable means comprising a plurality of cables of equal transmission times, whereby upon the switching means being activated said electron beams are deflected simultaneously from entering the first aperture means.

12. The pulse generator of claim 7, wherein said first aperture means and said second aperture means are positioned opposite one another proximate the edges of said disk-shaped end portions of said frustoconical end members.

13. The pulse generator of claim 11, wherein said switching means comprises spark gap means for producing a spark to simultaneously power all of said electron beam deflection plates.

* * * * *